US005177553A

United States Patent [19]

Ohike et al.

[11] Patent Number: 5,177,553

[45] Date of Patent: Jan. 5, 1993

[54] METHOD OF CONTROLLING BRUSH ROTATION IN A CLEANING DEVICE OF AN IMAGE FORMING SYSTEM

[75] Inventors: Hideaki Ohike; Keiji Konishi, both of Kanagawa, Japan

[73] Assignee: Fuji Xerox Co., Ltd., Tokyo, Japan

[21] Appl. No.: 669,656

[22] Filed: Mar. 14, 1991

[30] Foreign Application Priority Data

Mar. 19, 1990 [JP] Japan ..... 2-69212

[51] Int. Cl.[5] ..... G03G 21/00

[52] U.S. Cl. ..... 355/301; 355/203; 355/296

[58] Field of Search ..... 355/202, 260, 203-209, 355/301, 302, 303, 305, 296, 297, 298

[56] References Cited

U.S. PATENT DOCUMENTS 3,985,436 10/1976 Tanaka et al. ..... 355/210 X
5,003,354 3/1991 Takamiya et al. ..... 355/305

FOREIGN PATENT DOCUMENTS 0111076 7/1983 Japan .
0195559 10/1985 Japan .
0125182 1/1989 Japan .

*Primary Examiner*—A. T. Grimley
*Assistant Examiner*—Thu Dang
*Attorney, Agent, or Firm*—Finnegan, Henderson, Farabow, Garrett and Dunner

[57] ABSTRACT

A method of controlling rotation of a brush in a cleaning device of an image forming system. In the method, the brush is raced together with the photoreceptor which is in contact with the brush for a predetermined time in a warming-up period before the image forming operation starts, in an image-forming rest period, or when a new cartridge constituted by the photoreceptor and the cleaning device is set into the image forming system, so that the hairs of the brush which have been transformed during the rest of rotation are recovered into their original shapes.

4 Claims, 7 Drawing Sheets

METHOD OF CONTROLLING BRUSH ROTATION IN A CLEANING DEVICE OF AN IMAGE FORMING SYSTEM

BACKGROUND OF THE INVENTION

1. Field of the Invention

The present invention relates to a method of controlling brush rotation in a cleaning device of an image forming system, in which a brush is made to rub against the surface of a photoreceptor so as to scrape off toner or talc adhering to the surface of the photoreceptor.

2. Description of the Related Art

FIG. 7 is a schematic view illustrating the configuration of a laser printer using an electrostatic copying machine. In the laser printer, an image signal transmitted from an external equipment (not shown) such as a computer or a word processor forms a latent image on a photoreceptor 5 by means of a laser light 4 incident through an optical system 3 including a polygon mirror 2. This latent image is developed in a developing device 6 and then transferred by means of a transfer portion 9 onto paper 8 fed from a paper feeding device 7.

The paper 8 carrying a toner image transferred thereto is fed to a fusing device 11 by means of a transport 10, and the paper 8 fused therein through heating is then discharged.

A cleaning device 12 is constituted by a brush 13 which is in contact, while rotating, with the rotating photoreceptor 5, a doctor blade 14 which is provided on the downstream side of the brush 13 so as to contact with the surface of the photoreceptor 5 in the direction opposite to the rotating direction of the photoreceptor 5, an auger 15 which discharges toner scraped from the photoreceptor 5, a housing 16 which houses the members described above, and so on.

The above-mentioned photoreceptor 5 is supported by a frame (now shown) which is provided integrally with the housing 16 of the cleaning device 12, and the photoreceptor 5 and the cleaning device 12 are provided in the form of a cartridge so as to be removable from the copying machine body in the direction of pulling out. This cartridge is hereinafter referred to as a print cartridge.

The brush 13 provided in the cleaning device 12 having such a configuration as described above is a so-called disturber brush. The brush 13 has a configuration in which number of hairs 18, for example, 60,000 hairs per $in^2$, are planted in a core material 17 as shown in FIG. 8. Each hair 18 is composed of a material such as a copolymer of polypropylene or acrylic resin and vinyl chloride. These hairs 18 of the brush 13 contact, while flexing, with the photoreceptor 5.

The hairs 18 of the brush 13 contacting with the photoreceptor 5 are therefore left as they are being flexed at the time of stoppage of the copying machine. Thus, because the hairs 18 of the brush 13 are left in a state that they are in contact with the photoreceptor 5 while contacting with the latter for a long time, they are transformed as shown in FIG. 9 so that a concave portion 19 is produced.

If the operation of copying is performed in a condition that such a concave portion 19 is formed, a fluctuation of velocity is caused in the photoreceptor rubbed by the brush as shown in FIG. 10, so that a stripe pattern generally called banding is produced in an image on the photoreceptor 5 to thereby cause a defect in copying.

As a conventional countermeasure thereto, the brush is arranged so that it can be retracted from the photoreceptor in an unused time thereof, or hairs of the brush are made thin enough to prevent banding.

In the former one of the above-mentioned conventional countermeasures, there have been not only a problem that the printer is expensive because of the complicated retractable arrangement of the brush but another problem that the retracting operation causes leakage of toner. In the latter, on the other hand there has been a problem that the function of scraping off toner or talc adhering to the photoreceptor 5 is weakened.

SUMMARY OF THE INVENTION

It is therefore an object of the present invention to solve the foregoing problems.

It is another object of the present invention to provide a method of controlling rotation of a brush in a cleaning device of an image forming system, in which only the brush of cleaning device is made to race for a predetermined time before the copying operation is commenced or in a copying rest period (stand-by period) so that the transformation produced in the hairs of the brush at the time of stoppage can be recovered, the banding problem caused by the falling of the hairs of the brush can be solved by a simple improvement, that is, only a change in a controlling software, and the performance of scraping toner or talc from the surface of a photoreceptor can be maintained in the same manner as in the conventional one.

In order to attain the foregoing objects, a method according to the invention of controlling rotation of a brush in a cleaning device of an image forming system having a photoreceptor, comprises a step of racing the brush together with the photoreceptor which is in contact with the brush for a predetermined time.

BRIEF DESCRIPTION OF THE DRAWINGS

Other features and advantages of the present invention will be apparent from the following description taken in connection with the accompanying drawings, wherein:

FIG. 2 is a flow chart illustrating a racing operation at the time of stand-by;

DETAILED DESCRIPTION OF THE PREFERRED EMBODIMENTS

The present inventors first made various experiments to know where matters stand now.

Figure 4:
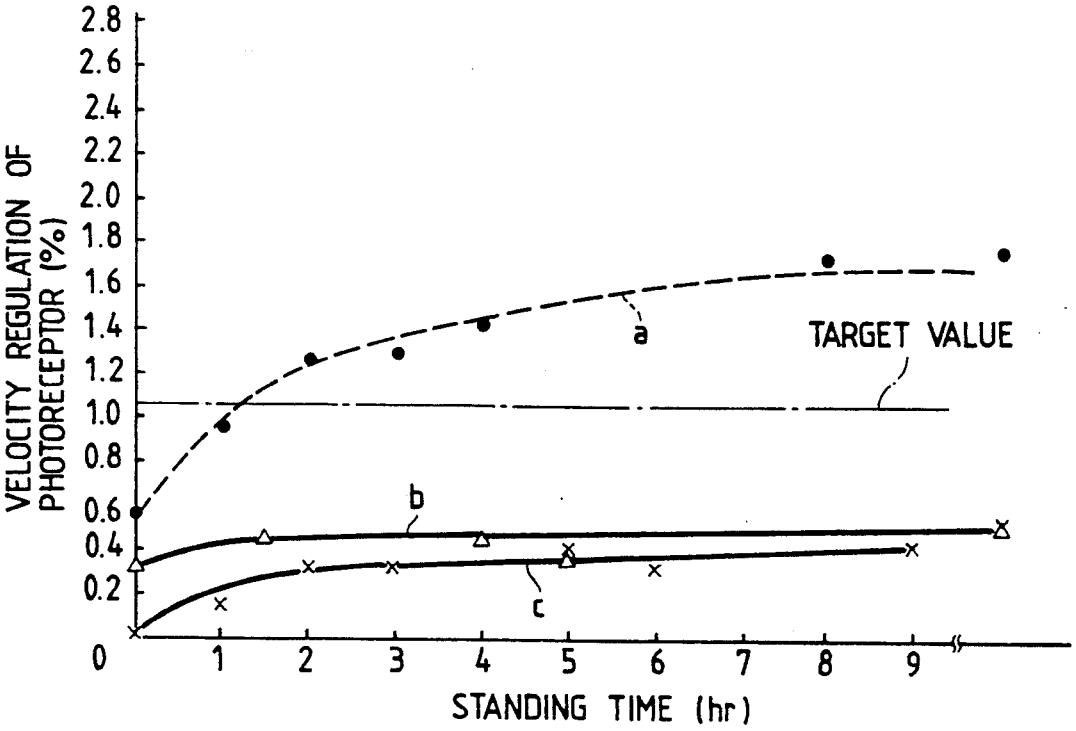
FIG. 4 is a diagram illustrating the velocity regulation of a photoreceptor with respect to the standing time of the same.

FIG. 4 shows the relationship between the time (hr) in which a brush 13 was left as it was in a state of stoppage and the velocity regulation (%) of a photoreceptor due to the brush 13. In FIG. 4, a represents the case of using a brush in which the material of hairs thereof was polypropylene, the outer diameter of the brush was 18 mm, and the thickness and density of the hairs were 17 deniers and 60,000/in$^2$ respectively; b represents the case of using a brush which was the same as the above-mentioned brush except that the hairs of which were inclined; and c represents the case of using a brush in which the material of hairs was copolymer of acrylic resin and vinyl chloride, the outer diameter of the brush was 18 mm, and the thickness and density of the hairs were 20 deniers and 60,000/in$^2$ respectively.

As understood from this drawing, it was found that the velocity regulation of the photoreceptor due to the brush became larger as the standing time got longer, and in the case a the velocity regulation went over a target value (shown by the one-dot chain line) after about one-hour standing.

Figure 5:
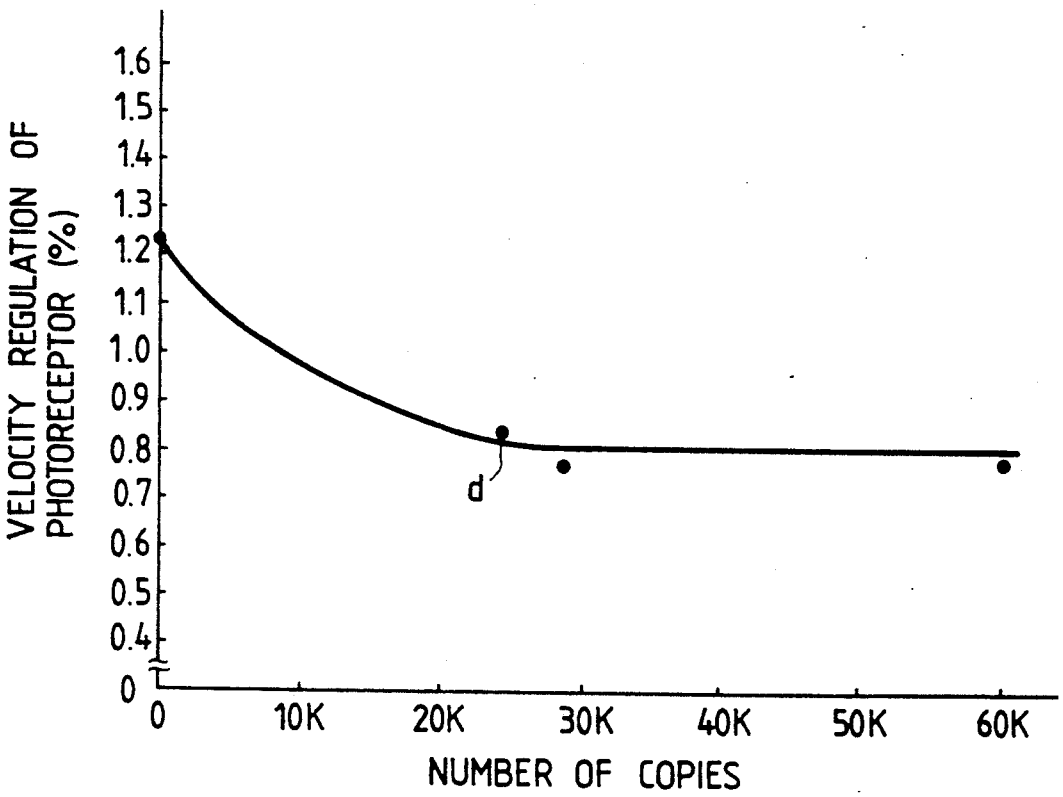
FIG. 5 is a diagram illustrating the velocity regulation of the photoreceptor with respect to the number of copies.

FIG. 5 shows the relationship between the number of copies and the velocity regulation of a photoreceptor in the case where the working of copying was performed after 1.5-hours. In FIG. 5, d represents the case of using a brush in which the material of hairs was polypropylene, the outer diameter of the brush was 18 mm, and the thickness and density of the hairs were 17 deniers and 60,000/in$^2$ respectively. In this case, the regulation was large when the number of copies was small, and the regulation had saturated since the number of copies was over 25k (25,000).

Figure 6:
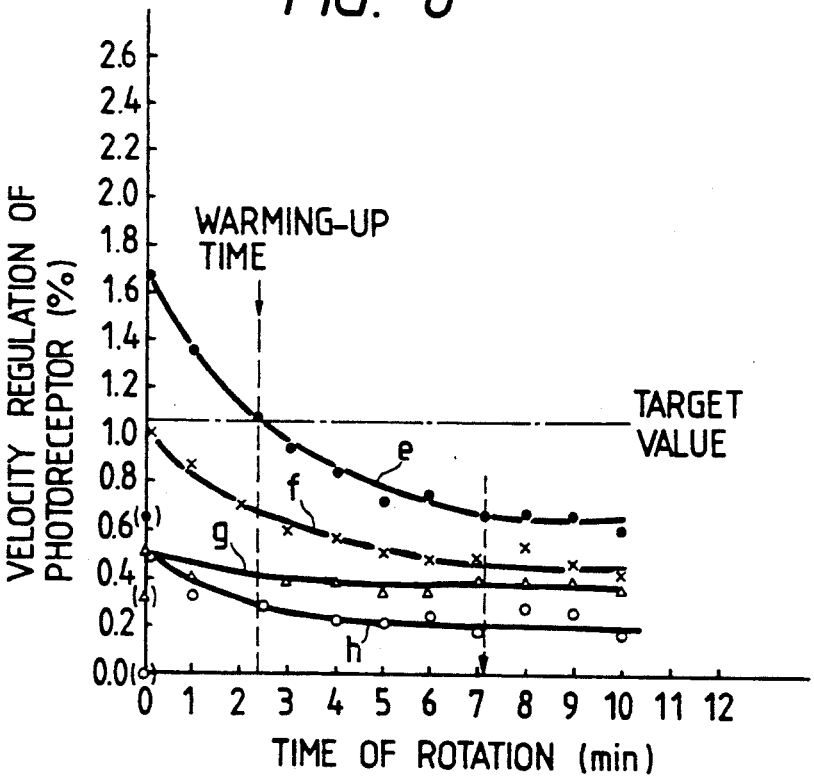
FIG. 6 is a diagram illustrating the velocity regulation of the photoreceptor with respect to the time of rotation of the same.

FIG. 6 shows the relationship between the velocity regulation of the photoreceptor and the time of rotation when a brush which had been left as it was for 12 hours was rotated again. In FIG. 6, e represents the case of using a brush in which the material of hairs was polypropylene, the outer diameter of the brush was 18 mm, and the thickness and density of the hairs were 17 deniers and 60,000/in$^2$ respectively; f represents the case of using a brush in which the material of hairs was polypropylene, the outer diameter of the brush was 19 mm, and the thickness and density of the hairs were 8.5 deniers and 60,000/in$^2$ respectively; g represents the case of using a brush in which the material of hairs was polypropylene, the outer diameter of the brush was 18 mm, and the thickness and density of the hairs were 17 deniers and 60,000/in$^2$ respectively; and h represents the case of using a brush in which the material of hairs was copolymer of acrylic resin and vinyl chloride, the outer diameter of the brush was 18 mm, and the thickness and density of the hairs were 20 deniers and 60,000/in$^2$ respectively.

As a result of these experiments shown in FIG. 6, it was found that in the case e, if the brush was left as it was for 12 hours (one night) after it was stopped, it was necessary to make the brush race for about 2.5 minutes to obtain the velocity regulation of the photoreceptor which was not larger than the target value.

Further, as a result of the above-mentioned experiments, it was found that in the case e, it was necessary to make the brush race for at least 2.5 minutes within two hours in a copying rest period (stand-by period).

The method according to the present invention has been attained on the basis of the results of the above-mentioned respective experiments, in which a brush is made to race together with a photoreceptor (1) in a warming-up time (according to the first aspect of the invention), (2) in a stand-by time (according to the second aspect of the invention), and (3) at a time of exchanging a cartridge constituted by a photoreceptor and a cleaning device (according to the third aspect of the invention). Preferred embodiments according to the various aspects of the invention will be described hereunder.

In these embodiments, a brush in was used which the material of hairs was polypropylene, the outer diameter of the brush was 19 mm, and the thickness and density of the hairs were 8.5 deniers and 60,000/in$^2$ respectively.

Figure 11:
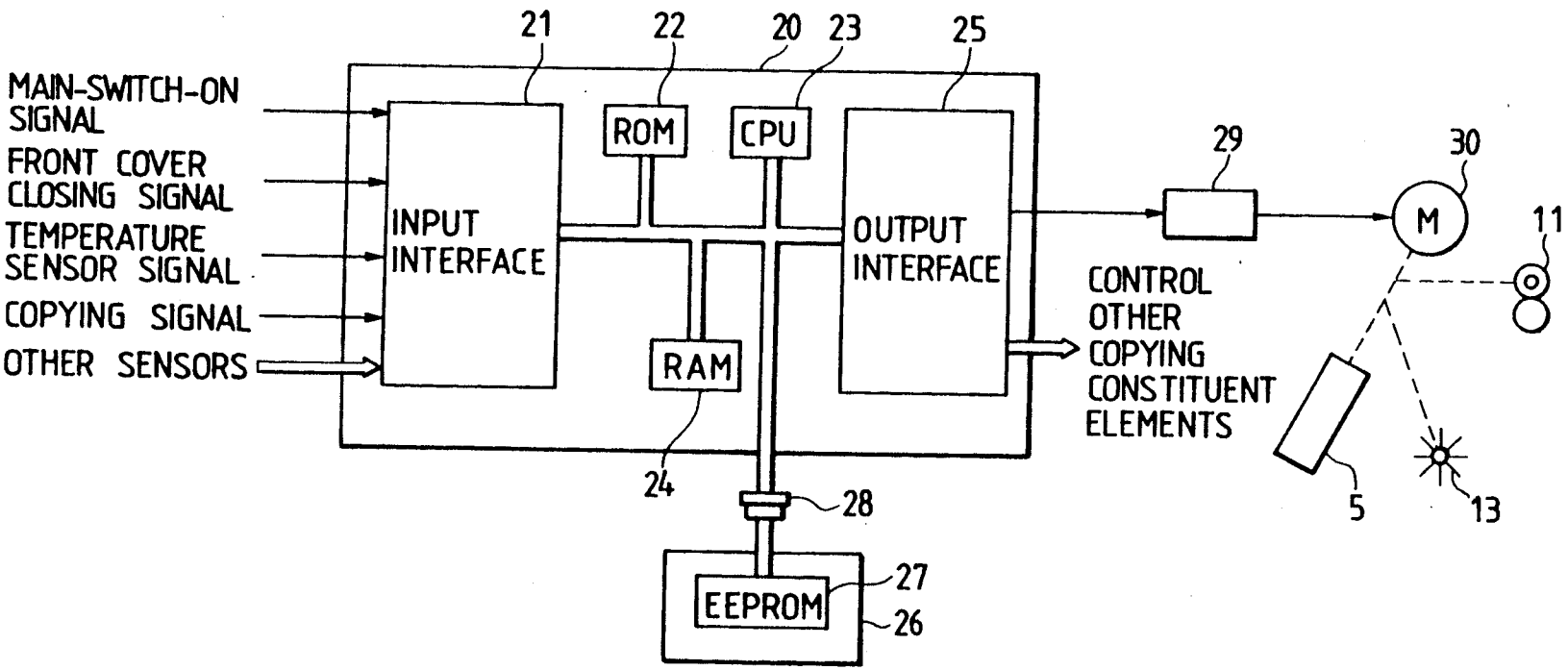
FIG. 11 is a diagram illustrating a control circuit according to the present invention.

FIG. 11 shows a control circuit according to the present invention. In the control circuit, a control device 20 is provided with a central processing unit (CPU) 23, a read-only memory (ROM) 22 having a predetermined copying machine operating program stored therein, an input interface 21 for receiving signals from sensors disposed in various portions in the copying machine, a random access memory (RAM) 24 for temporarily storing signals supplied from the input interface 21 or operation results of the CPU 23, and an output interface 25 for outputting signals for operating copying constituent elements disposed in various respective portions of the copying machine.

The CPU 23, the ROM 22, the input interface 21, the RAM 24 and the output interface 25 are connected to each other through a data base so that they can exchange communication of data with each other in accordance with commands from the CPU 23. As shown in the flow chart which will be described later, the control device 20 controls the copying machine.

Figure 7:
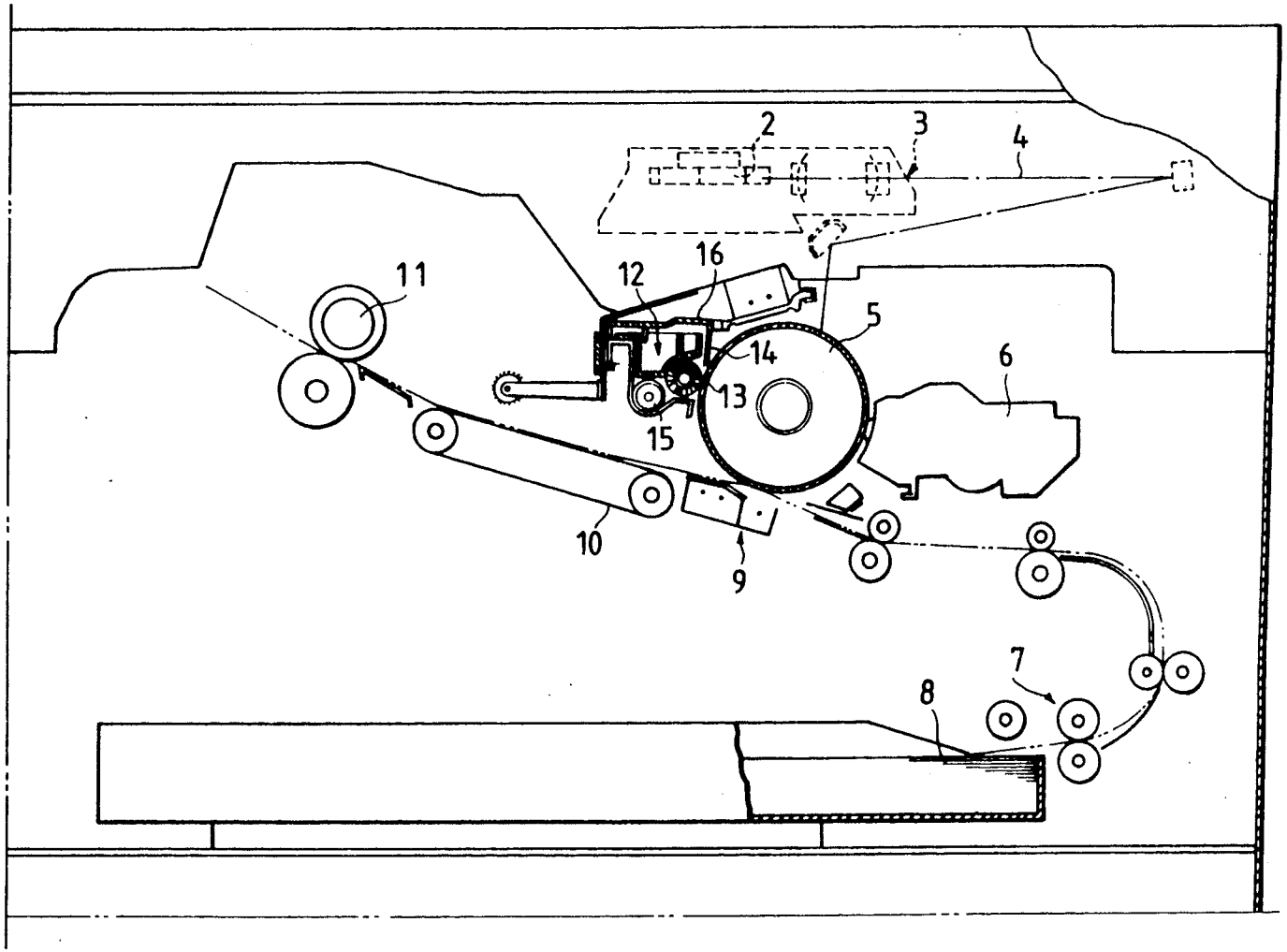
FIG. 7 is a schematic view for explaining the configuration of a copying machine.
Figure 9:
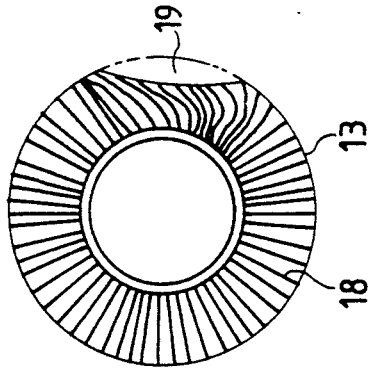
FIG. 9 is a side view illustrating the brush whose hairs are transformed.
Figure 8:
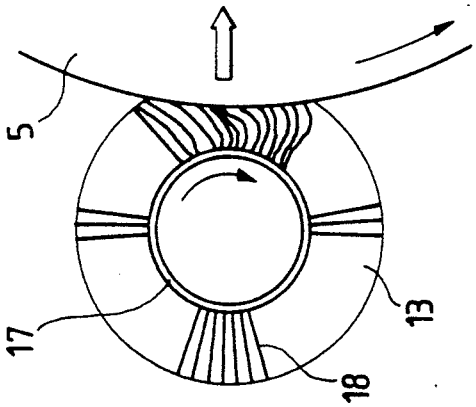
FIG. 8 is a side view illustrating a brush arranged to contact and rub the photoreceptor.
Figure 10:
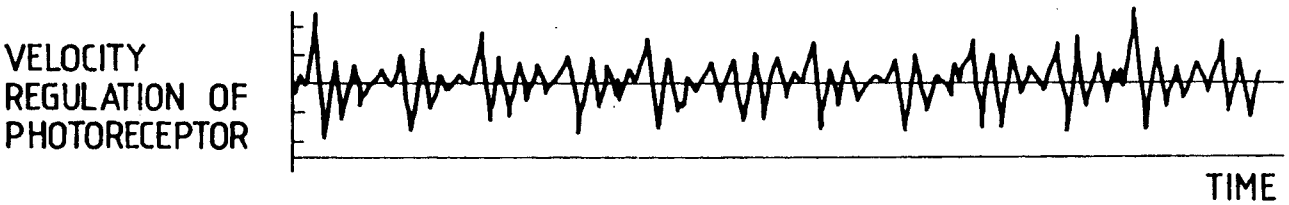
FIG. 10 is a diagram illustrating the velocity regulation of the photoreceptor.

This control device 20 is connected, through a connector 28, to a print cartridge substrate 26 disposed in a print cartridge which has been described in FIG. 7. In this print cartridge substrate 26, provided is an electrically erasable programmable read only memory (EEPROM) 27 carrying data showing the life of the print cartridge, data showing an unused print cartridge necessary for the present invention, and other data which have been stored therein.

The input interface 21 is supplied with a signal showing that a main switch (not shown) is turned on, a signal showing that a front cover (not shown) provided in the operational front side of the copying machine is closed, a temperature sensor signal from a sensor (not shown) for detecting the temperature of the fusing roll of the fusing device 11 shown in FIG. 7, a copying signal showing that a copying operation starts, and other signals from various other sensors and from an operation panel (not shown) disposed in the copying machine.

From the output interface 25, control signals are output for controlling a main motor driving circuit 29 for driving a main motor 30 of the copying machine and other of the copying machine constituent members of the copying machine such as a paper carrying path driving motor, a clutch indicator, and so on. The main motor 30 is connected to the main motor driving circuit 29 so that the main motor 30 rotates not only the photoreceptor 5 but also the brush 13 in the cleaning device 12 through a gear and a timing belt. In addition, the rotational power of this main motor 30 is transmitted to the fusing device 11.

The present invention will be described more in detail separately for various conditions.

(1) In the time of warming-up

If a main switch (not shown) which is a power source switch of the copying machine is turned on, the temperature of the fusing device 11 is made high in the state of stoppage of the main motor 30, that is, in the state the fusing device 11 is not rotated. This is because the thermal efficiency of the fusing device improves if the device is not rotated.

Figure 1:
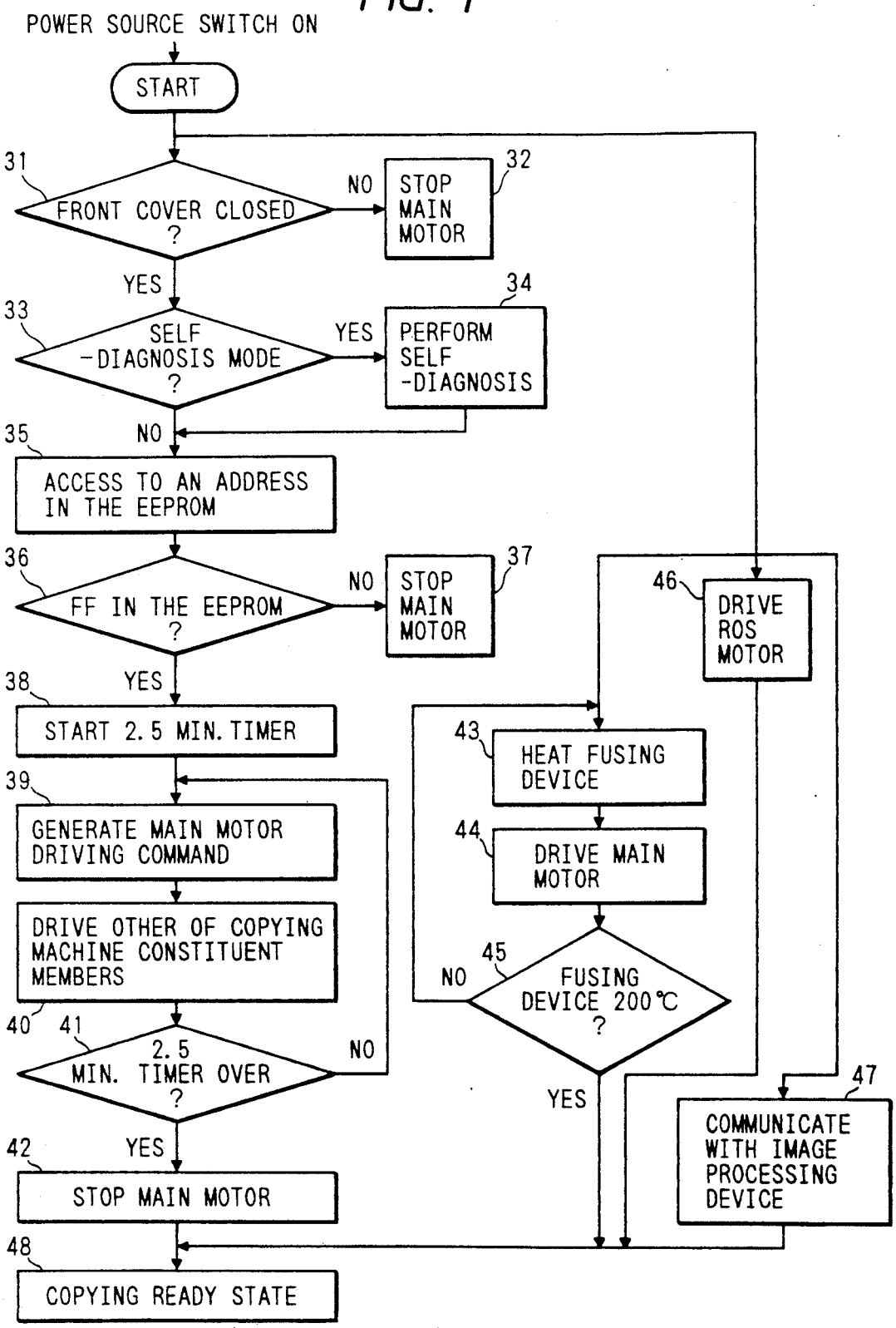
FIG. 1 is a flow chart illustrating a racing operation at the time of exchanging a print cartridge.

FIG. 1 shows a flow chart.

If the power source switch, that is, the main switch (not-shown), is turned on to supply power to respective electric constituent parts in the copying machine, a main-switch-on signal indicating the ON-state of the main switch is supplied to the control device 20 shown in FIG. 11 to start the control on the copying machine. A program is started by this main-switch-on signal. After the power source is turned on, first, the program control heats a heater of the fusing device 11 shown in FIG. 7 (Step 43). The period until the temperature of the fusing device 11 reaches a predetermined value (about 200° C.) is called a warming-up time. In this period, the control device 20 performs the control, which will be described thereafter, to rotate the main motor 30.

At a point of time after a period of time in which no trouble is caused in warming-up the fusing device 11, for example, after a lapse of about 130 sec, a racing cycle is started so that the main motor 30 is driven and the photoreceptor 5 and the brush 13 of the cleaning device 12 are made to race (Step 44). This racing is continued for a time not longer than 30 sec.

Figure 3:
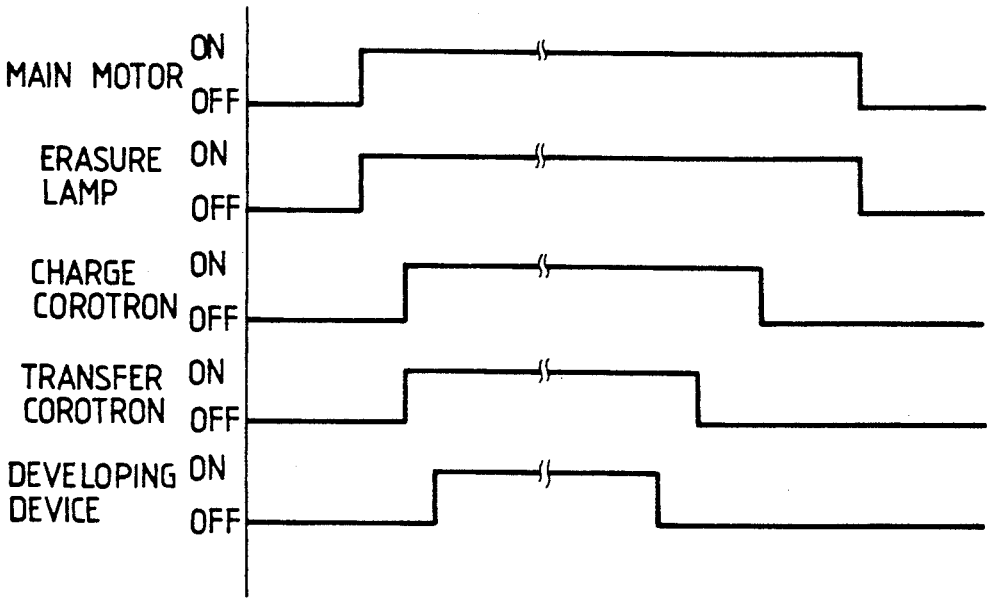
FIG. 3 is a timing chart illustrating operations of respective portions.

At this time, an erasure lamp is turned on at the same time as the above-mentioned main motor 30 is driven, then a charge corotron and a transfer corotron are controlled, and after that, the developing device 6 is controlled, while a very small quantity of toner is supplied to the photoreceptor 5 in this racing cycle. FIG. 3 shows the timing at this time.

In the above-mentioned racing cycle, when the fusing device 11 becomes about 200° C., a cycle-out mode (erasure or static elimination cycle) is started (Step 45). This cycle-out mode is performed for about 3,000 msec, that is, only the time of one rotation of the photoreceptor.

In this warming-up time, if a copying signal is supplied during the racing cycle or during the cycle-out mode, a copying mode is started after the cycle-out mode is terminated.

In a period before the racing cycle starts after the main switch is turned on (not longer than 130 sec), a normal operation is performed.

(2) In the time of stand-by

In the stand-by time, in the state where the main switch has been turned on, the main motor is driven for about 1,000 msec, preferably for 200 msec, at intervals of 30 minutes to rotate the photoreceptor 5 and the brush 13 so as to change the position of the brush 13 at which the brush 13 contacts with the photoreceptor 5.

That is:

(i) Racing is performed at intervals of 30 minutes in the case where no copying signal is supplied after the main switch is turned on;

(ii) Racing is performed at intervals of 30 minutes after the cycle-out when copying is finished; and (iii) Racing is performed at intervals of 30 minutes if no copying signal is supplied after racing is executed.

Figure 2:
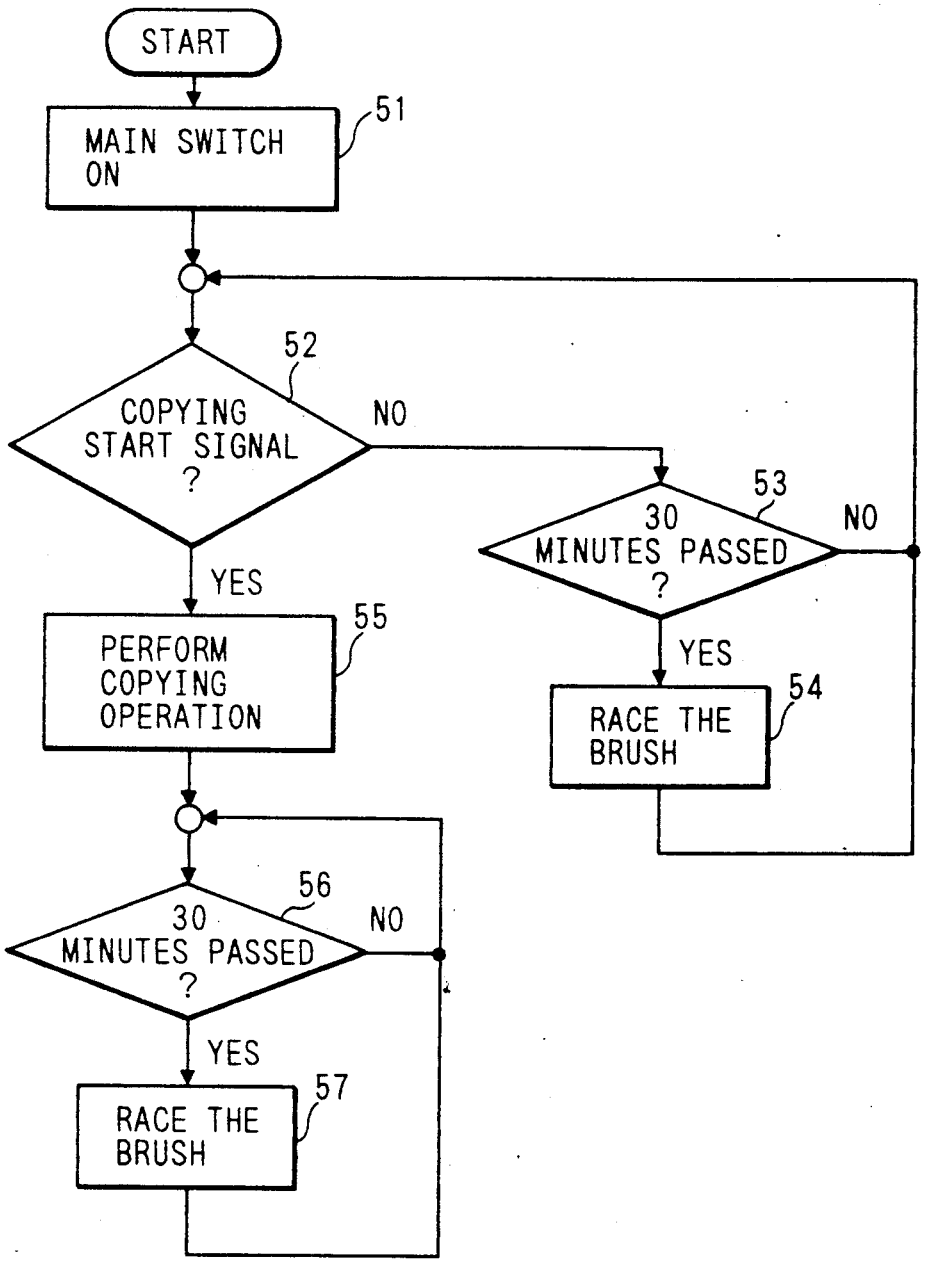

FIG. 2 shows a flow chart of the racing rotation operation in the above-mentioned stand-by time.

The control in the stand-by time will be described with reference to the flow chart. If the main switch is turned on (Step 51), a judgement is made as to whether there is a copying start signal or not (Step 52). If there is no copying start signal, the operation advances through the path of NO and a judgment is made as to whether 30 minutes have passed or not by use of a timer in the control device 20 (Step 53). If 30 minutes has not yet passed, the detection of existence of a copying start signal is, continued in Step 52. If 30 minutes have passed in Step 54, the operation advances to Step 53 in which the brush 13 is made to race.

The time for this racing is about 1,000 msec as has been described.

As has been described, in the time of stoppage of copying, racing is performed for 1,000 msec at intervals of 30 minutes.

If a copying start signal is supplied in Step 52, a copying operation is performed to make up a copy (Step 55). If the copying operation is finished and the cycle-out period is over, a counting operation is made as to whether 30 minutes has passed or not (Step 56). If 30 minutes have passed, the brush 13 is made to race for 1,000 msec (Step 57).

(3) At the time of exchange of a print cartridge constituted by a photoreceptor and a cleaning device The exchange of a print cartridge is detected by detecting the fact that the number of copies performed by this print cartridge is in a range between 0 and 1,000, and after the main switch is turned on, the same operation as in the above-mentioned warming-up time is executed, that is, a racing mode is executed for 2.5 to 3.5 minutes after 130 sec have passed after the main switch is turned on, and thereafter a cycle-out mode is started.

FIG. 1 also shows a flow chart of the above-mentioned racing mode at the time of exchange of the print cartridge.

That is, if the power source switch is turned on, the control device 20 shown in FIG. 11 operates to start execution of a program. The control device 20 determines whether the front cover is closed or not (Step 31), and if the cover is closed, the control device 20 performs self-diagnosis (Steps 33 and 34). If the cover is not closed, the main motor 30 is stopped (Step 32).

Thereafter, the control device 20 makes access to an address in the EEPROM 27 shown in FIG. 11 provided in the print cartridge, in which a state signal indicating if this print cartridge has been used or not is stored (Step 35). This address carries predetermined data (for example, the number FF expressed by the hexadecimal number system in the embodiment) which is written when the print cartridge is produced in a factory. Therefore, this data is a value showing that the print cartridge has never been used.

Next, a judgment is made as to whether the contents in the EEPROM 27 indicate the value FF or not (Step 36), and if not this value, the main motor 30 is stopped (Step 37). If the EEPROM 27 gives the value FF, a 2.5-minute timer included in the control device 20 is started (Step 38), and a main motor driving command is generated so as to rotate the main motor 30 so that the brush 13 coupled with this motor 30 is rotated (Step 39). Then, other copying machine constituent members are driven (Step 40). If the 2.5-minute timer has counted 2.5 minutes and indicates the time is over, the main motor 30 is stopped (Steps 41 and 42).

If all the above-mentioned Steps and Steps 43, 46 and 47 are finished, the copying machine is put in a copying ready state so as to enable copying (Step 48). Here, a ROS (Raster Output Scanner) motor for driving a polygon mirror which scans a laser beam is driven in Step 46, and a communication with an image processing device which outputs data to be recorded is performed in Step 47.

If a copying operation is started thereafter to make up a copy, the above-mentioned data FF in the EEPROM 27 is changed to another value. Thus, it is possible to determine whether the print cartridge is a new one or not.

According to the present invention, without changing an internal structure of a copying machine, it is possible to correct the transformation of hairs of the brush caused by stoppage of the copying machine by properly arranging the electric timing, that is, by making a photoreceptor and a brush of a cleaning device race for a predetermined time in the stand-by time and before a copying operation, and it is possible to solve a banding problem caused by the falling of the hairs of the brush only by a simple improvement, that is, only by changing software. Further, it is possible to maintain the performance of scraping toner or talc from the surface of the photoreceptor in the same manner as in the convention case.

What is claimed is:

1. A method of controlling rotation of a brush containing brush hairs in a cleaning device of an image forming system having a photoreceptor, comprising the steps of:

driving a motor means; and racing the brush together with the photoreceptor, which is in contact with said brush, using the motor means, for a predetermined time in order to recover from a transformation produced in the hairs of the brush at a time of stoppage of an image forming process.

2. The method according to claim 1, wherein said racing step is performed in a warming-up period until a temperature of a fusing device of the image forming system reaches a predetermined value after a main switch of the image forming system is turned on.

3. The method according to claim 1, wherein said racing step is performed at predetermined time intervals in an image-forming rest period in a state where a main switch of the image forming system is being turned on.

4. The method according to claim 1, wherein said racing step is performed when a new cartridge member constituted by the photoreceptor and the cleaning device is set into the image forming system.

* * * * *